United States Patent [19]

Suhara et al.

[11] Patent Number: 4,561,946

[45] Date of Patent: Dec. 31, 1985

[54] ELECTROLYTIC CELL FOR THE ELECTROLYSIS OF AN ALKALI METAL CHLORIDE AND PROCESS OF USING SAID CELL

[75] Inventors: Manabu Suhara; Yasuo Sajima; Hiroaki Ito; Kiyotaka Arai, all of Yokohama, Japan

[73] Assignee: Asahi Glass Company Ltd., Tokyo, Japan

[21] Appl. No.: 637,889

[22] Filed: Aug. 6, 1984

[30] Foreign Application Priority Data

Aug. 12, 1983 [JP] Japan ..... 58-146662

[51] Int. Cl.[4] ..... C25B 1/46; C25B 13/02

[52] U.S. Cl. ..... 204/98; 204/128; 204/252; 204/283; 204/296

[58] Field of Search ..... 204/98, 128, 252, 263–266, 204/282, 283, 296

[56] References Cited

U.S. PATENT DOCUMENTS

| | | | |
|---|---|---|---|
| 3,431,193 | 3/1969 | Balej et al. | 204/283 |
| 4,056,452 | 11/1977 | Campbell | 204/282 |
| 4,057,479 | 11/1977 | Campbell | 204/258 |
| 4,210,511 | 7/1980 | Campbell et al. | 204/283 |
| 4,344,832 | 8/1982 | Dahlberg | 204/282 |
| 4,381,985 | 5/1983 | Ryder, Jr. | 204/296 |
| 4,390,575 | 6/1983 | Kopp | 204/296 |
| 4,411,749 | 10/1983 | Sato et al. | 204/283 |
| 4,461,682 | 7/1984 | Oda et al. | 204/283 |

FOREIGN PATENT DOCUMENTS

| | | | |
|---|---|---|---|
| 0029751 | 3/1981 | European Pat. Off. | 204/98 |
| 0061594 | 6/1982 | European Pat. Off. | 204/296 |
| 0066127 | 12/1982 | European Pat. Off. | 204/296 |
| 0112487 | 9/1981 | Japan | 204/98 |
| 0131378 | 8/1982 | Japan | 204/98 |
| 0192282 | 11/1982 | Japan | 204/296 |

*Primary Examiner*—Andrew H. Metz
*Assistant Examiner*—Terryence Chapman
*Attorney, Agent, or Firm*—Oblon, Fisher, Spivak, McClelland & Maier

[57] ABSTRACT

An electrolytic cell for the electrolysis of an alkali metal chloride, wherein an ion-exchange membrane provided at least on one side thereof with a gas and liquid permeable non-electrocatalytic porous layer, is disposed between an anode and a cathode so that the porous layer is in contact with the facing electrode, said ion-exchange membrane being provided on its porous layer surface with grooves which form continuous void spaces and secure passages for the electrolyte at the interface between the electrode and the ion-exchange membrane.

8 Claims, 8 Drawing Figures

FIGURE 1-(i)
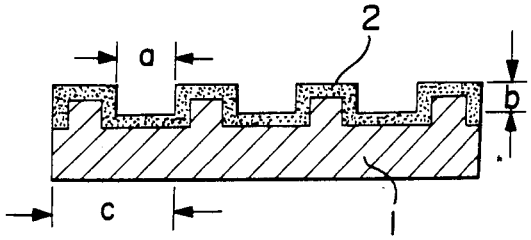
FIGURE 1-(ii)
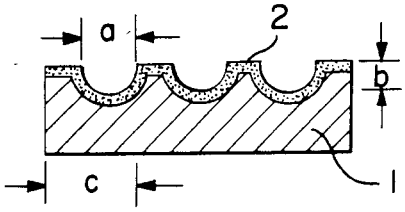
FIGURE 1-(iii)
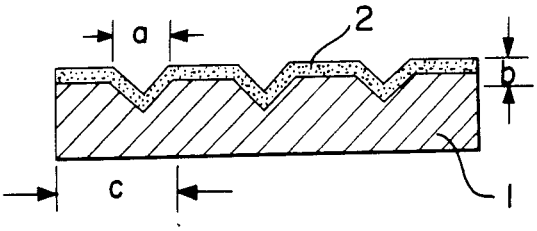
FIGURE 1-(iv)
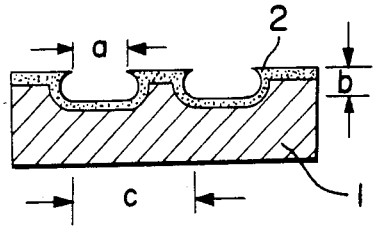

FIGURE 2-(i)
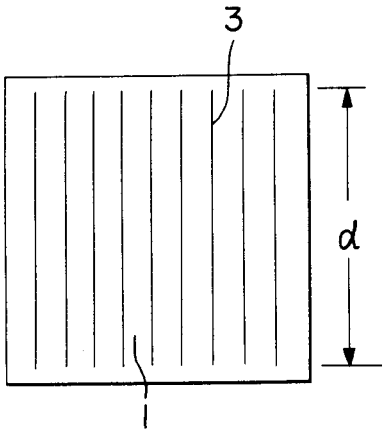
FIGURE 2-(ii)
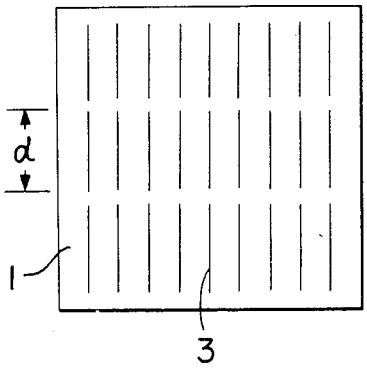
FIGURE 2-(iii)
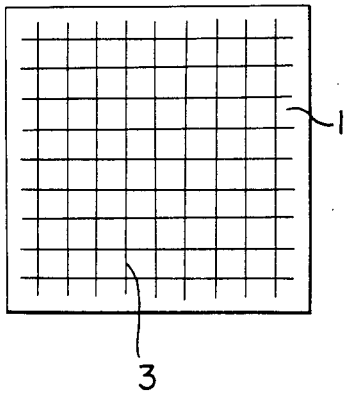
FIGURE 2-(iv)
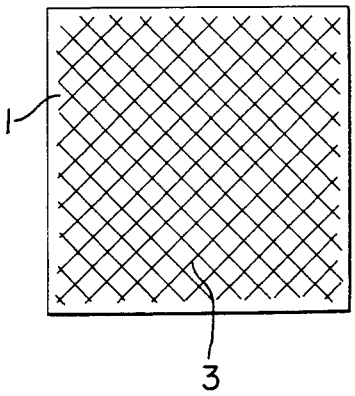

ELECTROLYTIC CELL FOR THE ELECTROLYSIS OF AN ALKALI METAL CHLORIDE AND PROCESS OF USING SAID CELL

FIELD OF THE INVENTION

The present invention relates to an electrolytic cell for the electrolysis of an alkali metal chloride. More particularly, it relates to an electrolytic cell for the electrolysis of an alkali metal chloride, in which an ion-exchange membrane is disposed substantially vertically and which is capable of producing chlorine gas containing oxygen gas of a low oxygen concentration at the anode at a low cell voltage.

DESCRIPTION OF THE PRIOR ART

As a process for producing an alkali metal hydroxide and chlorine by the electrolysis of an aqueous solution of an alkali metal chloride, a diaphragm method has been used in place of a conventional mercury method. Further, in order to efficiently obtain an alkali metal hydroxide having a high purity in a high concentration, it has been proposed and put into practical application to employ an ion-exchange membrane process.

On the other hand, from the standpoint of energy saving, it is desired to reduce the cell voltage in an ion-exchange membrane process as much as possible. For this purpose, various means have been proposed. However, this object has not yet adequately been attained for a reason such that the electrolytic cell tends to have a complicated structure.

It has been proposed that the above object can adequately be attained by using an electrolytic cell wherein a cation exchange membrane has an electrocatalytically inactive gas and liquid permeable porous layer on at least one surface thereof, i.e. at least the anode or cathode side of the ion exchange membrane. The inventions based on this discovery have been made the subject matters of earlier U.K. Pat. No. 29751 or European Patent Publication No. 29751.

The effect for reducing the electrolytic voltage attinable by the use of a cation exchange membrane having such a porous layer on its surface, varies depending upon the kind, the porosity and the thickness of the material constituting the porous layer. However, even when the porous layer is made of a non-conductive material as mentioned hereinafter, substantially the same voltage reducing effect is obtainable.

It has also been proposed that when an ion-exchange membrane having a gas and liquid permeable porous layer on the surface, is used, the minimum cell voltage is attainable if the porous layer is in contact with the electrode. However, it has been found that with this electrolytic cell, the oxygen concentration in the chlorine gas generated at the anode can not necessarily be reduced.

The cause for such undesirable phenomenon is not entirely clear, but it is conceivable that no adequate passage for the electrolyte is secured and proton can not readily be supplied to the interface between the ion exchange membrane and the anode, and consequently a liquid having a high pH will be brought in contact with the anode, whereby the oxygen concentration tends to be high. In some cases, such a phenomenon can not be neglected for electrolytic cells for industrial purposes.

The present inventors have continued the study with an aim to suppress such a phenomenon, and have found that the above object can adequately be attained in a practical manner by providing grooves on the porous layer side of the ion exchange membrane to form continuous void spaces and to secure passages for the electrolyte at the interface between the electrode and the ion exchange membrane having the gas and liquid permeable porous layer.

SUMMARY OF THE INVENTION

The present invention provides an electrolytic cell for the electrolysis of an alkali metal chloride, wherein an ion-exchange membrane provided at least on one side thereof with a gas and liquid permeable non-electrocatalytic porous layer, is disposed between an anode and a cathode so that the porous layer is in contact with the facing electrode, said ion-exchange membrane being provided on its porous layer surface with grooves which form continuous void spaces and secure passages for the electrolyte at the interface between the electrode and the ion-exchange membrane.

Now, the present invention will be described in detail with reference to the preferred embodiments.

BRIEF DESCRIPTION OF THE DRAWINS

In the accompanying drawings, FIGS. 1–(i) to 1–(iv) are partial cross sectional views of the ion-exchange membranes illustrating various shapes of the grooves formed on the porous layer surfaces of the ion-exchange membranes to be used for the electrolytic cell of the present invention.

FIGS. 2–(i) to 2–(iv) are plan views of ion-exchange membranes illustrating the arrangements of the grooves formed on the porous layer surfaces of the ion-exchange membranes to be used for the electrolytic cell of the present invention.

DESCRIPTION OF THE PREFERRED EMBODIMENTS

With respect to the grooves to be provided on the porous layer surface of the ion-exchange membrane, the object of the present invention can be attained so long as they will provide continuous void spaces and secure the passages for the electrolyte at the interface between the ion-exchange membrane and the electrode as mentioned above. However, the degree of attainment of the purpose of the invention varies depending upon the shape, the direction and the number of such grooves.

In the present invention, the grooves to be provided on the porous layer surface of the ion-exchange membrane may preferably have a square, circular, triangular or elliptic cross section as illustrated in FIGS. 1–(i) to 1–(iv). Their width (a) on the porous layer surface is preferably from 0.1 to 10 mm, more preferably from 0.5 to 5 mm, and the depth (b) is preferably at least 0.03 mm, more preferably from 0.05 mm to a half of the thickness of the membrane. The pitch (c) of the grooves may vary depending upon the width (a) of the grooves, but is preferably from 0.1 to 20 mm, more preferably from 0.5 to 10 mm. The pitch (c) is preferably in proportion to the width (a). Namely, it is preferred that the greater the width (a), the greater the pitch (c). Further, the length (d) of the grooves is preferably at least 5 mm, more preferably at least 10 mm, as illustrated in FIG. 2.

The grooves on the porous layer surface are preferably inclined at an angle of upto 60° preferably upto 45° relative to the vertical direction or most preferably directed vertically. However, the grooves may be inclined at an angle beyond 60°, although the effect of the present invention will be substantially reduced. In some cases, the grooves may be provided in a horizontal direction. The arrangement of the grooves on the porous layer surface is preferably determined to have a certain geometric pattern as shown in FIG. 2. However, the grooves may entirely or partially be randomly arranged.

Further, the grooves of the porous layer surface may be provided so that a plurality of differently directed grooves are provided to cross one another, as shown in FIG. 2-(iii) and 2-(iv). In any case, it is important that the continuous void spaces are formed and electrolyte passages are provided at the interface between the ion-exchange membrane and the electrode. Accordingly, by virtue of the above-mentioned grooves on the porous layer surface, the void spaces are preferably inclined at an angle of upto 60° relative to the vertical direction or most preferably directed vertically. Likewise, the length of the void spaces is preferably at least 5 mm, more preferably at least 10 mm. Further, it should be understood that the present invention is not restricted to the strict sense of the term "grooves" on the surface of the ion-exchange membrane, and extends to cover, e.g. a case where the porous layer surface are partially protruded to provide linear protrusions, whereby the object of the present invention is likewise attained.

Various methods may be employed for the formation of the grooves on the porous layer surface of the ion-exchange membrane. It is preferred to employ a method wherein the porous layer surface of the ion-exchange membrane is roll-pressed by means of a grooved roll having predetermined grooves on its surface, or a flat plate pressing method wherein a grooved flat plate having grooves of a predetermined shape on its surface is used. Further, the porous layer may be provided on the ion-exchange membrane surface so that the predetermined grooves are preliminarily formed on the porous layer itself.

The depth of the grooves is not necessarily required to have a predetermined relation with the thickness of the porous layer formed on the ion-exchange membrane surface. However, the thickness of the grooves is preferably greater than the thickness of the porous layer. Namely, the depth of the grooves is preferably from 5 to 50 times, more preferably from 10 to 30 times, the thickness of the porous layer.

The ion-exchange membrane having on its surface a gas and liquid permeable porous layer to be used in the present invention, may be formed by bonding particles on the membrane surface. The amount of the particles deposited to form the porous layer may vary depending upon the nature and size of the particles. However, it is preferably from 0.001 to 100 mg, preferably from 0.005 to 50 mg per $cm^2$ of the membrane surface, according to the study of the present inventors. If the amount is too small, no desired effect of the present invention can be obtained, and if the amount is too large, the electric resistance of the membrane increases, such being undesirable.

The particles to form the gas and liquid permeable porous layer on the surface of the cation exchange membrane may be made of electro-conductive or non-conductive inorganic or organic material so long as they do not function as an electrode during an electrolysis. However, they are preferably made of a material which is resistant to corrosion in the electrolytic solution. As typical examples, there may be mentioned a metal or a metal oxide, hydroxide, carbide or nitride or a mixture thereof, carbon or an organic polymer.

As preferred specific materials for the porous layer on the anode side, there may be used a single substance of Group IV-A of the Periodic Table (preferably, silicon, germanium, tin or lead), Group IV-B (preferably, titanium, zirconium or hafnium), Group V-B (preferably, niobium or tantalum), an iron group metal (iron, cobalt or nickel), chromium, manganese or boron, or its alloy, oxide, hydroxide, nitride or carbide, or polytetrafluoroethylene, or ethylene-tetrafluoroethylene copolymer.

On the other hand, for the porous layer on the cathode side, there may advantageously be used, in addition to the materials useful for the formation of the porous layer on the anode side, silver or its alloy, stainless steel, carbon (activated carbon or graphite), or silicon carbide ($\alpha$-type or $\beta$-type), as well as a polyamide resin, a polysulfone resin, a polyphenyleneoxide resin, a polyphenylenesulfide resin, a polypropylene resin or a polyimide resin.

For the formation of the porous layer, the above-mentioned particles are used preferably in a form of powder having a particle size of from 0.01 to 300 $\mu$m, especially from 0.1 to 100 $\mu$m. If necessary, there may be incorporated a binder of e.g. a fluorocarbon polymer such as polytetrafluoroethylene or polyhexafluoroethylene, or a viscosity-increasing agent, for instance, a cellulose material such as carboxymethyl cellulose, methyl cellulose or hydroxyethyl cellulose, or a water soluble substance such as polyethylene glycol, polyvinyl alcohol, polyvinyl pyrrolidone, sodium polyacrylate, polymethylvinyl ether, casein or polyacrylamide. The binder or the viscosity-controlling agent is used in an amount of preferably from 0 to 50% by weight, especially from 0.5 to 30% by weight.

Further, if necessary, there may further be added a suitable surfactant such as a long chained hydrocarbon or a fluorohydrocarbon, or graphite or other electro-conductive fillers to facilitate the bonding of the particles to the membrane surface.

To bond the particles or particle groups (mass) to the surface of the ion-exchange membrane, a binder and a viscosity-increasing agent which are used as the case requires, are adequately mixed in a suitable solvent such as an alcohol, a ketone, an ether or a hydrocarbon to obtain a paste, which is then applied to the membrane surface by transfer or screen printing. Alternatively, it is possible to deposit the particles or particle groups on the membrane surface by forming a syrup or slurry of a mixture of the particles instead of the paste of the mixture, and spraying or hot pressing the syrup or slurry onto the membrane surface.

The porous layer-forming particles or particle groups are then preferably pressed under heating by means of a press or rolls preferably at a temperature of from 80° to 220° C. under pressure of 1 to 150 kg/$cm^2$. It is preferred that they are partially embedded in the membrane surface.

The porous layer thus formed by the particles or particle groups bonded to the membrane surface preferably has a porosity of at least 10%, especially at least 30%, and a thickness of from 0.01 to 200 $\mu$m, especially from 0.1 to 50 $\mu$m. The thickness of the porous layer is preferably thinner than the thickness of the ion-exchange membrane.

The porous layer may be formed on the membrane surface in a form of a densed layer where a great amount of the particles are bonded to the membrane surface or in a form of a single layer wherein the particles or particle groups are bonded to the membrane surface independently without being partially in contact with one another. In the latter case, it is possible to substantially reduce the amount of the particles to form the porous layer, and in certain cases, the formation of the porous layer can be simplified.

In the present invention, the ion-exchange membrane on which the porous layer is to be formed, is preferably made of a fluorine-containing polymer having cation exchange groups such as carboxylic acid groups, sulfonic acid groups, phosphoric acid groups or phenolic hydroxyl groups. Such a membrane is prererably made of a copolymer of a vinyl monomer such as tetrafluoroethylene or chlorotrifluoroethylene with a fluorovinyl monomer containing ion exchange groups such as sulfonic acid groups, carboxylic acid group or phosphoric acid groups.

It is particularly preferred to employ a polymer having the following repeating untis (i) and (ii):

$$(CF_2-CXX') \quad \text{(i)}$$

$$(CF_2-\underset{\underset{Y}{|}}{C}X) \quad \text{(ii)}$$

where X is F, Cl, H or $-CF_3$, X' is X or $CF_3(CF_2)_m$ where m is from 1 to 5, and Y is selected from the following groups:

$$(CF_2)_xA,\ -O(CF_2)_xA,\ (O-CF_2-\underset{\underset{Z}{|}}{C}F)_yA,\ -CF_2-O(CF_2)_xA,$$

$$(O-CF_2-\underset{\underset{Z}{|}}{C}F)_x(O-CF_2-\underset{\underset{R_f}{|}}{C}F)A,$$

$$-CF_2(O-CF_2-\underset{\underset{Z}{|}}{C}F)_x(O-CF_2-\underset{\underset{R_f}{|}}{C}F)_yA,$$

$$-O-CF_2(\underset{\underset{Z}{|}}{C}F-O-CF_2)_x(CF_2)_y(CF_2-O-\underset{\underset{R_f}{|}}{C}F)_zA$$

where each of x, y and z is from 0 to 10, and each of Z and $R_f$ is selected from the group consisting of —F or a perfluoroalkyl group having from 1 to 10 carbon atoms. Further, A is $-SO_3M$ or —COOM, or a group which can be converted to such groups by hydrolysis, such as $-SO_2F$, —CN, —COF or —COOR, where M is a hydrogen atom or an alkali metal, and R is an alkyl group having from 1 to 10 carbon atoms.

The cation exchange membrane used in the present invention, preferably has an ion exchange capacity of from 0.5 to 4.0 meq/g dry resin, more preferably from 0.8 to 2.0 meq/g dry resin. In order to obtain such an ion exchange capacity, the ion-exchange membrane made of a copolymer having the above-mentioned polymerization units (i) and (ii), preferably contain from 1 to 40 mol %, more preferably from 3 to 25 mol %, of the polymerization unit (ii).

The cation exchange membrane used in the present invention, may not necessarily be formed from one type of a polymer and may not necessarily have only one type of ion exchange groups. For example, there may be used a laminated membrane composed of two types of polymer sheets so that the cathode side has a smaller ion exchange capacity, or an ion-exchange membrane having weakly acidic exchange groups such as carboxylic acid groups on the cathode side and strongly acidic exchange groups such as sulfonic acid groups on the anode side.

These ion-exchange membranes may be prepared by various conventional methods. Further, these ion-exchange membranes may preferably be reinfoced by a woven fabric such as cloth or a net, or a non-woven fabric, made of a fluorine-containing polymer such as polytetrafluoroethylene, or by a metal mesh or perforated sheet. The thickness of the ion-exchange membrane of the present invention is preferably from 50 to 1000 μm, more preferably from 100 to 500 μm.

When the porous layer is to be formed on the anode side or a cathode side, or on both sides of the ion-exchange membrane, as mentioned above, the ion exchange groups of the membrane should take a suitable form not to lead to decomposition thereof. For instance, in the case of carboxylic acid groups, they should preferably take a form of an acid or an ester, and in the case of sulfonic acid groups, they should preferably take a form of $-SO_2F$.

When the above-mentioned grooves are to be provided on the ion-exchange membrane having on its surface a gas and liquid permeable porous layer, the operation is preferably conducted in the same manner as in the above-mentioned formation of the porous layer on the ion-exchange membrane, i.e. in the case where the ion exchange groups of the membrane are carboxylic acid groups, the ion exchange groups should preferably take a form of an acid or an ester, and in the case of the sulfonic acid groups, they should preferably take a form of $-SO_2F$. The operation is preferably conducted by roll pressing or flat plate pressing, preferably at a pressing temperature of from 60° to 280° C. under a roll pressing pressure of from 0.1 to 100 kg/cm or a flat plate pressing pressure of from 0.1 to 100 kg/cm$^2$. The formation of the porous layer and the formation of the grooves may be conducted simultaneously, as mentioned above.

Any type of electrodes may be applied to the membrane of the present invention. For instance, there may be employed perforated electrodes such as foraminous plates, nets or expanded metals. As the porous electrode, there may be mentioned an expanded metal having openings with a long diameter of from 1.0 to 10 mm and short diameter of from 0.5 to 10 mm, the wire diameter of from 0.1 to 1.3 mm and an opening rate from 30 to 90%, or a punched metal having openings of a circular, elliptic or diamond shape and an opening rate of from 30 to 90%. Further, a plate-like electrode may also be used. The effectiveness of the present invention is remarkable particularly when electrodes having a smaller opening rate are used. Further, in the present invention, a plurality of electrodes having different opening rates may be employed.

The anode may usually be made of a platinum group metal or its electro-condutive oxides or electro-condutive reduced oxides. On the other hand, the cathode may be made of a platinum group metal, its electro-conductive oxides or an iron group metal. As the platinum group metal, there may be mentioned platinum, rhodium, ruthenium, paradium and iridium. As the iron group metal, there may be mentioned iron, cobalt, nickel, Raney nickel, stabilized Raney nickel, stainless steel, an alkali etching stainless steel (U.S. Pat. No. 4,255,247), Raney nickel-plated cathode (U.S. Pat. Nos.

4,170,536 and 4,116,804) and Rodan nickel-plated cathode (U.S. Pat. Nos. 4,190,514 and 4,190,516).

In the case where perforated electrodes are used, the electrodes may be made the above-mentioned materials for the anode or cathode. However, when a platinum group metal or its electro-conductive oxides are used, it is preferred to coat these substances on the surface of an expanded metal made of a valve metal such as titanium or tantalum.

When the electrodes are to be disposed in the present invention, at least anode or cathode, preferably both are arranged to be in contact with the gas and liquid permeable porous layer having the grooves on the surface. On the other hand, in the case of an ion-exchange membrane having a gas and liquid permeable porous layer having no grooves on the surface, or an ion-exchange membrane having no porous layer on the surface, may be arranged in contact with the electrode or it may be arranged with a space from the electrode. The contact between the electrode and membrane should preferably be made under a moderate pressure, for instance, the electrode is pressed against the porous layer under a pressure of e.g. from 0 to 20 kg/cm$^2$, rather than strongly pressing the electrode and membrane to one another.

In the present invention, in the case where only one of the anode side and the cathode side of the ion-exchange membrane is provided with the porous layer, the electrode disposed to face with the side of the ion-exchange membrane on which no porous layer is provided, may be disposed in contact with or out of contact with the ion-exchange membrane.

The electrolytic cell of the present invention may be a monopolar type or bipolar type so long as it has the above-mentioned construction. With respect to the material constituting the electrolytic cell, for instance, in the case of the anode compartment for the electrolysis of an aqueous alkali metal chloride solution, a material resistant to an aqueous alkali metal chloride solution and chlorine, such as a valve metal like titanium, may be used, and in the case of the cathode, iron, stainless stell or nickel resistant to an alkali hydroxide and hydrogen, may be used.

In the present invention, the electrolysis of an aqueous alkali metal chloride solution may be conducted under conventional conditions. For instance, the electrolysis is conducted preferably at a temperature of from 80° to 120° C. at a current density of from 10 to 100 A/dm$^2$ while supplying preferably a 2.5–5.0 N alkali metal chloride aqueous solution to the anode compartment and water or diluted alkali metal hydroxide to the cathode compartment. In such a case, it is preferred to minimize the presence of heavy metal ions such as calcium or magnesium in the aqueous alkali metal chloride solution, since such heavy metal ions bring about a deterioration of the ion-exchange membrane. Further, in order to prevent as far as possible the generation of oxygen at the anode, an acid such as hydrochloric acid may be added to the aqueous alkali metal chloride solution to adjust the pH value of the solution to preferably less than 3.

Now, the present invention will be described in further detail with reference to Examples. However, it should be understood that the present invention is by no means restricted by these specific Examples.

EXAMPLE 1

Tetrafluoroethylene and $CF_2=CFO(CF_2)_3COOCH_3$ were copolymerized in a trichlorotrifluoroethane solvent in the presence of azobisisobutyronitrile as a catalyst to obtain a copolymer having an ion exchange capacity of 1.25 meq/g dry resin, and a copolymer having an ion exchange capacity of 1.80 meq/g dry resin.

The film having an ion exchange capacity of 1.25 meq/g and a thickness of 30 μm and the film having an ion exchange capacity of 1.80 meq/g and a thickness of 180 μm were subjected to compression molding at a temperature of 220° C. under pressure of 25 kg/cm$^2$ for 5 minutes to obtain a laminated membrane.

On the other hand, a mixture comprising 10 parts by weight of zirconium oxide powder having a particle size of 5 μm, 0.4 part by weight of methylcellulose (a 2% aqueous solution having a viscosity of 1500), 19 parts by weight of water, 2 parts by weight of cyclohexanol and 1 part by weight of cyclohexanone, was kneaded to obtain a paste. The paste was screen-printed on the anode side surface of the above cation exchange membrane having an ion exchange capacity of 1.80 meq/g, by means of a printing plate comprising a tetron screen having 200 mesh and a thickness of 75 μm and a screen mask having a thickness of 30 μm provided therebeneath and a squeezee made of polyurethane. The layer deposited on the membrane surface was dried in air.

Then, on the other surface of the membrane having the porous layer thus formed on the anode side, α-silicon carbide particles having an average particle size of 5 μm were likewise deposited.

Thereafter, the particle layers on the respective sides of the membrane were press-bonded to the respective sides of the ion-exchange membrane at a temperature of 140° C. under pressure of 30 kg/cm$^2$, whereby an ion-exchange membrane having a porous layer of 1.0 mg/cm$^2$ of zirconium oxide particles and a thickness of 10 μm on the anode side of the membrane and a porous layer of 0.7 mg/cm$^2$ of silicon carbide particles and a thickness of 10 μm on the cathode side of the membrane, was obtained.

The ion-exchange membrane thus having porous layers on both sides, was roll-pressed at a temperature of 140° C. under pressure of 20 kg/cm$^2$ with a grooved roll, to form a porous layer surface having, at the anode side, vertically directed continuous grooves (square cross section) having a width of 1.2 mm, a depth of 0.15 mm and a pitch of 1.5 mm. The membrane thickness was 200 μm at the grooved portions and 350 μm at non-grooved portions.

Such an ion-exchange membrane was immersed in an aqueou solution containing 25% by weight of sodium hydroxide at 90° C. for 16 hours for the hydrolysis of the ion exchange groups. On the anode side of the membrane thus obtained, an anode prepared by coating a solid solution of $RuO_2$, iridium oxide and titanium oxide on a titanium expanded metal (short opening diamer 4 mm, long opening diameter 8 mm) and having a low chlorine overvoltage, was pressed to be in contact with the ion-exchange membrane. Likewise, to the cathode side of the membrane, a cathode obtained by subjecting a punched metal made of SUS 304 (short opening diameter 4 mm, long opening diameter 8 mm) to etching treatment in an aqueous solution containing 52% by weight of sodium hydroxide at 150° C. for 52 hours, and having a low hydrogen overvoltage, was pressed to be in contact with the ion-exchange membrane. Then, electrolysis was conducted at 90° C. at a current density of 30 A/dm$^2$, while supplying an aqueous solution of 5 N sodium chloride adjusted to pH2 by an addition of hydrochloric acid, to the anode compartment and water to the cathode compartment, and maintaining the sodium chloride concentration in the anode compartment at a level of 3.5 N and the sodium hydroxide concentration of the cathode compartment to a level of 35% by weight.

As the results, the current efficiency was 95%, the cell voltage was 2.8 V, and the oxygen concentration in the chlorine gas obtained at the anode, was 0.3%.

COMPARATIVE EXAMPLE 1

The electrolysis was conducted in the same manner as in Example 1 by means of the same electrolytic cell and the same ion-exchange membrane except that the ion-exchange membrane was not roll-pressed by the grooved rolls. As the results, the current efficiency was 95% and the cell voltage was 2.8 V, but the oxygen concentration in the chlorine gas obtained in the anode compartment was 0.6%.

EXAMPLE 2

The same cation exchange membrane as used in Example 1 was used except that grooves (square cross section) was formed on the anode side porous layer surface composed of zirconium oxide particles by roll-pressing so as to bring the angle of the grooves to 30° relative to the vertical direction.

The grooves had a width of 2 mm, a depth of 0.1 mm, a length of 20 mm and a pitch of 2.5 mm. The thickness of the membrane was 300 m at the non-grooved portions. By using this membrane, the electrolysis was conducted in the same manner as in Example 1, whereby the current efficiency was 95%, the cell voltage was 2.8 V, and the oxygen concentration in the chlorine gas obtained in the anode compartment was 0.3%.

COMPARATIVE EXAMPLE 2

A membrane was prepared in the same manner as in Example 2 except that no porous layer on both sides was deposited. By using this membrane, the electrolysis was conducted in the same manner as in Example 1, whereby the current efficiency was 95%, but the cell voltage was 3.5 V. The oxygen concentration in the chlorine gas obtained in the anode compartment was 0.5%.

EXAMPLE 3

Tetrafluoroethylene and $CF_2=CFO(CF_2)_3COOCH_3$ were emulsion-polymerized in the presence of ammonium persulfate as a catalyst, whereby a polymer having an ion exchange capacity of 1.45 meq/g dry resin was obtained.

To this polymer, 2.7% by weight of polytetrafluoroethylene fine powder was mixed, kneaded and then formed by an extruder into a film having a thickness of 280 μm.

Porous layers were deposited in the same manner as in Example 1. A layer on one side was composed of zirconium oxide particles, and the layer on the other side was composed of silicon carbide particles. To the zirconium oxide layer side, flat plate pressing by means of a patterned plate was applied to form grooves (triangular cross section). The grooves had a width on the surface of 0.5 mm, a depth of 50 μm, a length of 5 mm and a pitch of 1.5 mm, and the grooves were directed vertically.

By using this membrane, the electrolysis was conducted in the same manner as in Example 1, whereby the current efficiency was 93%, and the cell voltage was 2.9 V. The oxygen concentration in the chlorine gas obtained in the anode compartment was 0.4%.

EXAMPLE 4

A polytetrafluoroethylene cloth was press-bonded to the 1.8 meq/g side of the laminated membrane obtained in Example 1, to obtain a cloth-reinforced membrane. Then, porous layers were deposited thereto in the same manner as in Example 1.

To the 1.8 meq/g side of this membrane, roll pressing was applied by means of a grooved roll to form grooves. The grooves had a width on the surface of 1.5 mm, a depth of 30 μm, a length of 10 mm and a pitch of 2 mm. The grooves having square cross sections were directed vertically. By using this membrane, the electrolysis was conducted in the same manner as in Example 1, whereby the current efficiency was 95%, and the cell voltage was 2.8 V. The oxygen concentration in the chlorine gas obtained at the anode compartment was 0.3%.

EXAMPLE 5

Tetrafluoroethylene and $CF_2=CFOCF_2CF(CF_3)OCF_2CF_2COOCH_3$ were copolymerized in a trichlorotrifluoroethane solvent in the presence of azobisisobutyronirile as a catalyst to obtain a copolymer having an ion exchange capacity of 0.90 meq/g dry weight.

On the other hand, tetrafluoroethylene and $CF_2=CFOCF_2CF(CF_3)OCF_2CF_2SO_2F$ were likewise copolymerized to obtain a copolymer having an ion exchange capacity of 0.91 meq/g dry resin.

The above carboxylic acid polymer and sulfonic acid polymer were co-extruded by means of a co-extruder to obtain a film having a thickness of 250 μm. The thickness of the carboxylic acid layer was 50 μm, and the thickness of the sulfonic acid layer was 200 μm.

As the porous layers, in the same manner as in Example 1, silicon carbide was deposited on the carboxylic acid layer side, and titanium oxide was deposited on the sulfonic acid layer side. To the sulfonic acid layer side, roll pressing was applied to form the same grooves as in Example 1.

This membrane was subjected to hydrolysis, and the electrolysis was conducted in the same manner as in Example 1 with the sulfonic acid layer side being the anode side, whereby the current efficiency was 96% and the cell voltage was 2.9 V. The oxygen concentration in the chlorine gas obtained in the anode compartment was 0.3%.

COMPARATIVE EXAMPLE 3

The electrolysis was conducted in the same manner as in Example 5 by means of the same electrolytic cell and the same ion-exchange membrane except that no roll pressing by the grooved roll was applied, whereby the current efficiency was 96% and the cell voltage was 2.9 V, but the oxygen concentration in the chlorine gas obtained in the anode compartment was 0.6%.

We claim:

1. An electrolytic cell for the electrolysis of an alkali metal chloride comprising:

an anode electrode, a cathode electrode, and an ion-exchange membrane therebetween; wherein said membrane is provided at least on one side thereof with a gas and liquid permeable non-electrocatalytic porous layer, whereby the porous layer completely covers the surface of at least one side of said membrane and is in contact with one of the electrodes; said ion-exchange membrane being provided on its porous layer surface with grooves which form continuous void spaces and secure passages for the electrolyte at the interface between the electrode and the ion-exchange membrane.

2. The electrolytic cell according to claim 1, wherein the grooves on the porous layer surface have a length of at least 1 mm, a width of from 0.1 to 10 mm and a depth of at least 0.03 mm.

3. The electrolytic cell according to claim 1, wherein the grooves on the porous layer surface are vertical or inclined at an angle of upto 60° from the vertical direction.

4. The electrolytic cell according to claim 1, wherein the ion-exchange membrane has the porous layer on the anode side so that continuous void spaces are formed at the interface with the anode.

5. The electrolytic cell according to claim 1, wherein the ion-exchange membrane is a cation exchange membrane composed of a fluorocarbon polymer having sulfonic acid groups, carboxylic acid groups or phosphoric acid groups.

6. A method for electrolysing an aqueous solution of an alkali metal chloride comprising eletrolysing the solution in an electrolytic cell as claimed in claim 1.

7. The method according to claim 6, wherein the electrolysis is conducted at a temperature of from 80° to 120° C. at a current density of from 10 to 100 $A/dm^2$ by supplying a 2.5–5.0 N alkali metal chloride aqueous solution to an anode compartment and water or an aqueous dilute alkali metal hydroxide solution to a cathode compartment.

8. The method according to claim 7, wherein the electrolysis is conducted while adding an acid to the anode compartment.

* * * * *